United States Patent [19]

Fast

[11] Patent Number: 5,040,316

[45] Date of Patent: Aug. 20, 1991

[54] PRODUCT INFORMATION DISPLAY TAG OF ADJUSTABLE LENGTH

[76] Inventor: Jacob Fast, 7561 NW. 9th St., Plantation, Fla. 33317

[21] Appl. No.: 326,798

[22] Filed: Mar. 21, 1989

[51] Int. Cl.[5] ..... G09F 1/00

[52] U.S. Cl. ..... 40/124.4; 40/124.1; 248/909

[58] Field of Search ..... 40/642, 124.4, 124.1, 40/657, 299; 248/909, 220.4, 300; 211/57.1, 59.1

[56] References Cited

U.S. PATENT DOCUMENTS

| | | | |
|---|---|---|---|
| 4,463,510 | 8/1984 | Windish | 40/124.4 |
| 4,525,944 | 7/1985 | Fast | 40/124.1 |
| 4,583,308 | 4/1986 | Taub | 40/642 |
| 4,665,639 | 5/1987 | Fast | 40/124.4 |
| 4,694,595 | 9/1987 | Fast | 40/642 |
| 4,698,929 | 10/1987 | Fast | 40/657 |
| 4,703,570 | 11/1987 | Fast | 40/657 |
| 4,715,135 | 12/1987 | Fast | 40/642 |
| 4,773,172 | 9/1988 | Fast | 40/657 |

*Primary Examiner*—Laurie K. Cranmer
*Assistant Examiner*—Brian K. Green
*Attorney, Agent, or Firm*—Fleit, Jacobson, Cohn, Price, Holman & Stern

[57] ABSTRACT

A product information and display tag for use with a horizontally extending product support hook, for presenting product information at a forward end of the hook has a rear part formed by a number of like mounting portions disposed end-to-end with tear lines therebetween. Each mounting portion is suitable for securing the tag to the proximal end of the hook. The tag can be used at its full length for longer hooks, or one or more of the mounting portions can be torn off to effectively reduce the length of the tag so that it can be used for shorter hooks.

1 Claim, 1 Drawing Sheet

PRODUCT INFORMATION DISPLAY TAG OF ADJUSTABLE LENGTH

BACKGROUND OF THE INVENTION

This invention relates to product information display tags for merchandise suspended from horizontally extending support hooks and the like. More particularly, the invention relates to such tags which are easily attached to and removed from support hooks without being subject to inadvertent removal and which display product information forwardly of the supported merchandise.

In recent years, I have developed a range of product information display tags of the above type for use with different types of support hooks, the tags in general being formed from plastic sheet so at provide a mounting portion which attaches to a support hook at the back or proximal end of the hook, an elongate intermediate portion which extends from the mounting portion forwardly over the hook (and the products suspended thereon) and a forward end display portion for product information which may be carried on a label secured to the display portion. The display portion itself may be integral with the remainder of the tag, or may be a separate detachable element. Examples of such tags may be seen, for instance, in my earlier U.S. Pat. Nos. 4,525,944; 4,703,570 and 4,715,135.

Generally, my earlier tags have been of a fixed length for use with support hooks of specified length. Thus, since there exists a range of hook lengths, it was necessary to provide an equivalent range of tags of different length. By contrast, the present invention provides an adjustable length tag which can be used with hooks of different length.

SUMMARY OF THE INVENTION

Generally stated, I have found that in order to provide a product information display tag of the type described which is of adjustable length to suit a variety of different length product support hooks, it is particularly convenient to replicate the mounting portion of the tag, in other words, provide the tag with at least two substantially identical mounting portions, one behind another, with tear-away means therebetween enabling the rearward mounting portion to be separated from the remainder of the tag. Thus, if a longer tag is required, the rearward mounting portion is retained intact and used as such with the forward mounting portion effectively being used as part of the elongate intermediate portion of the tag. Alternatively, if a short length tag is required, the rearward mounting portion is torn off and the forward mounting portion is used to mount the tag. To increase the length variations available, the inventive tag may have more than one tear-away mounting portion behind the forward mounting portion.

The invention is particularly useful with tags of the kind disclosed in U.S. Pat. No. 4,715,135, with which having a longitudinally reinforced, reduced width intermediate portion.

Additional features and advantages of the invention will be apparent from the ensuing description and claims read in conjunction with the accompanying drawings.

DESCRIPTION OF THE PREFERRED EMBODIMENT

Figures 1, 2, 3, 4:
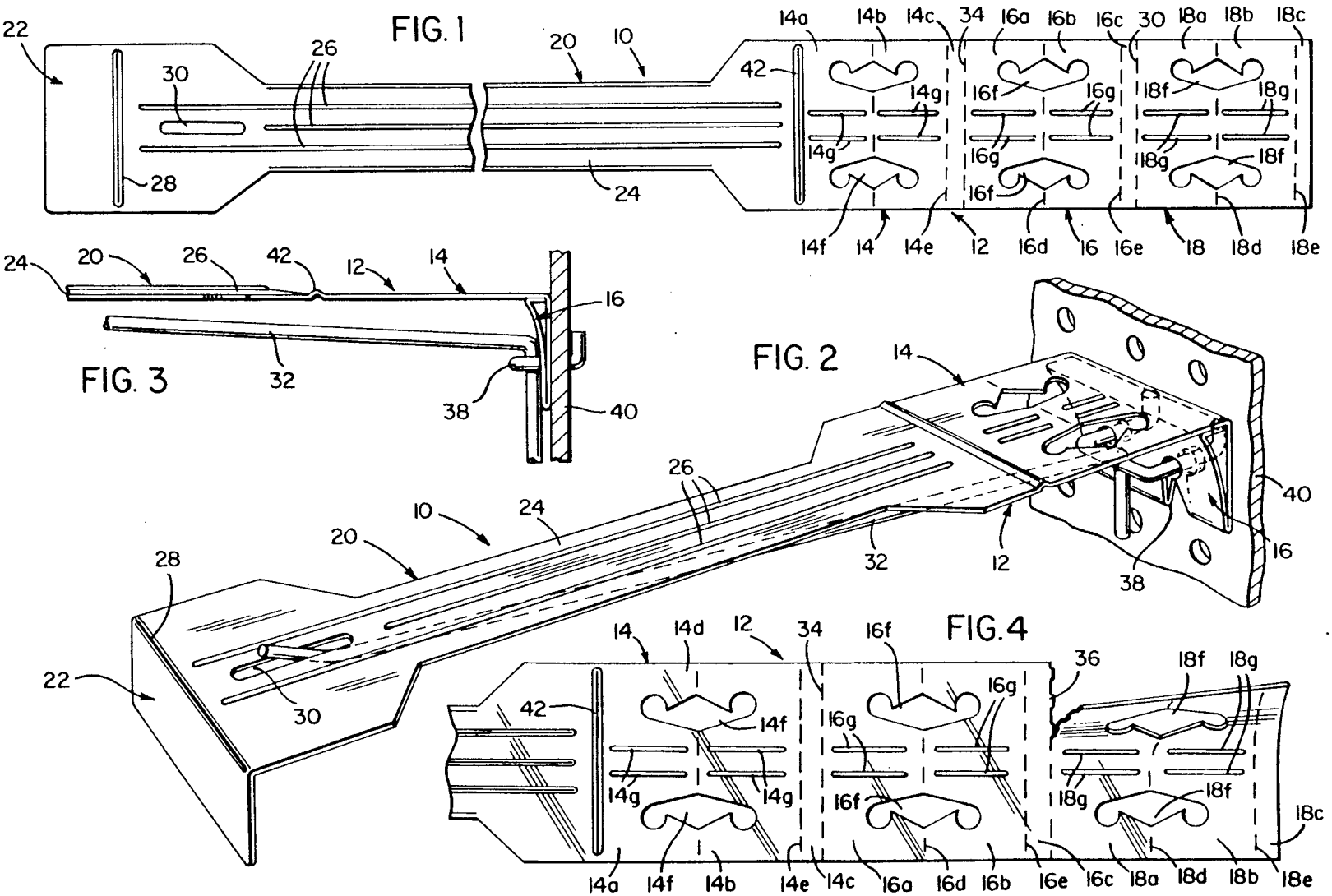
FIG. 1 is a plan view of a product information display tag according to the invention.
FIG. 2 is a perspective view of the tag in use mounted on a product support hook.
FIG. 3 is an elevational view of a rear part of the assembly shown in FIG. 2.
FIG. 4 is an enlarged plan view of a rear part of the tag showing a tear-away mounting portion.

Referring to the drawings, a product information display tag 10 according to the invention has a rear part 12 comprising three end-to-end tag mounting portions 14, 16, 18, an elongate intermediate portion 20 extending from the forwardmost mounting portion 14, and a forward end product display portion 22.

The intermediate portion 20 of the tag has a reduced width central section 24 with longitudinal reinforcing ribs 26, this structure and its uses being described in full in U.S. Pat. No. 4,715,135 incorporated herein by reference. More particularly, the reinforcing ribs promote transverse bowing of the tag which inhibits lengthwise bending, and the reduced width of the central section economizes on material and reduces the area available for dust collection.

A transverse fold line 28 separates the display portion 22 from the elongate portion 20 in known manner so that the display portion can be folded down as shown in FIG. 2. At its distal end, the elongate portion has a slot 30 for receiving t he distal end of a product support hook 32 also in known manner.

The respective mounting portions 14, 16 and 18 are connected to each other by respective transverse lines of perforations 34, 36 each of which extends across the entire width of the tag and which constitute tear-away means for the mounting portions 16 and 18. This enables the tag effectively to be adjusted to three different lengths. Thus, the tag can be used at its full length using portion 18 as the mounting portion. Alternatively, for a shorter product suspension hook (such as hook 32 in the illustrated embodiment), portion 18 can be torn away from the tag along tear line 36 (FIG. 4) and portion 16 used as the mounting portion (FIGS. 2 and 3). For a still shorter hook, both portions 16 and 18 can be torn away from the tag, along tear line 34 and portion 14 can be used as the mounting portion.

Each of the mounting portions comprise three end to end panels, the "a", "b", and "c" suffixes respectively separated by transverse fold lines, the "d" and "e" suffixes, whereby the mounting portion can be folded into a narrow wedge-like configuration, as shown in FIGS. 2 and 3, for mounting on the limbs 38 of hook 32 by means of cutouts, (the "f" suffix) in the respective mounting portion in known manner, as shown, for example, in FIGS. 9 and 11 of U.S. Pat. No. 4,715,135. The limbs 38 support hook 32, for example, in apertures of an apertured board 40, also in known manner.

To resist lengthwise bending, each mounting portion is provided with lengthwise reinforcing ribs (the respective "g" suffix) and mounting portion 14 is separated from elongate portion by a transverse reinforcing rib 42.

In order to insure that the end panels are torn away at one of the tear away means 34, 36 and not the fold lines **14*e*, 16*e* or 18*e* necessary to the formation of the wedge, the perforations used to form the fold lines designated by the suffix "e" do not extend to the longitudinal side edges of the tag mounting portions 14, 16 or 18 whereas the perforations used to form the tear-away means 34, 36 do extend to the side edges as shown in the drawings. Thus, when a user attempts to tear away one or more mounting portions, the tear will occur at the means 34, 36** and not at the fold line. Alternatively, the fold lines can be formed in other conventional manners without perforations to insure that tearing will preferably occur at the tear-away means.

While only a preferred embodiment of the invention has been described herein in detail, the invention is not limited thereby and modifications can be made within the scope of the attached claims. Thus, for example, the invention is also applicable to tags which do not have a reduced width central section, to tags having different forms of mounting portion structure from the specific three-panel structure herein described, and to tags having less or more than the three-panels shown.

What is claimed is:

1. An elongate product information display tag of adjustable length for selective use with horizontal product support hooks of different length, the tag having a rear part for attaching the tag to a proximal end of a hook, an elongate intermediate portion for extending over the hook, and a forward end display portion for providing product information at a distal end of the hook, wherein the rear part of the tag comprises at least two mounting portions disposed end to end, each mounting portion including means for securing the mounting portion to the proximal end of the hook, and the mounting portions being connected by tear-away means whereby at least a rearmost one of the mounting portions can selectively be used to secure the tag to a first hook or can be torn away and removed from the tag so that a remaining one of the mounting portions can be used to secure the tag to a second hook of shorter length than the first hook, wherein each mounting portion includes means defining transverse fold lines for folding the mounting portion into a shape suitable for securing the mounting portion to the proximal end of the hook and wherein the tag includes means for promoting preferential tearing of the tag along said tear-away means rather than said fold lines wherein said tear-away means comprises a transverse perforated tear line extending entirely across the tag, and wherein said means for promoting preferential tearing comprises said transverse fold lines stopping short of longitudinal side edges of the tag and perforations of said tear lines extending into said side edges of the tag.

* * * * *